United States Patent [19]

Akatsuka et al.

[11] 4,005,392

[45] Jan. 25, 1977

[54] METHOD AND APPARATUS FOR DETECTING AND RECORDING ABNORMAL CONDITIONS IN THE OPERATION OF SPINNING MACHINES

[75] Inventors: Takeaki Akatsuka; Akinori Kato; Teiryo Kojima; Sinji Inaba, all of Otsu; Kohichi Higashino, Kyoto, all of Japan

[73] Assignee: Toray Industries, Inc., Tokyo, Japan

[22] Filed: July 31, 1975

[21] Appl. No.: 600,712

[30] Foreign Application Priority Data

| | | |
|---|---|---|
| Aug. 2, 1974 | Japan | 49-88683 |
| Aug. 2, 1974 | Japan | 49-88686 |
| Aug. 2, 1974 | Japan | 49-88687 |

[52] U.S. Cl. ..... 340/172.5; 340/146.1 R

[51] Int. Cl.² ..... G06F 3/04; G06F 3/14; G06F 11/06

[58] Field of Search ..... 340/172.5, 146.1 R, 340/146.1 C; 235/151.1, 153 A, 151.3; 318/565

[56] References Cited

UNITED STATES PATENTS

| | | | |
|---|---|---|---|
| 3,303,471 | 2/1967 | Duncan et al. | 340/172.5 |
| 3,535,683 | 10/1970 | Woods et al. | 340/172.5 |
| 3,588,832 | 6/1971 | Duncan | 340/172.5 |
| 3,629,855 | 12/1971 | Conley | 340/172.5 |
| 3,771,132 | 11/1973 | Biewer | 340/172.5 |
| 3,809,869 | 5/1974 | Gebald | 235/151.3 |
| 3,824,558 | 7/1974 | Koshiba | 340/172.5 |
| 3,836,768 | 9/1974 | Clarke et al. | 340/172.5 X |
| 3,876,863 | 4/1975 | Boone | 340/172.5 X |
| 3,922,642 | 11/1975 | Tooka | 340/172.5 |

*Primary Examiner*—Melvin B. Chapnick

[57] ABSTRACT

A method of and apparatus for controlling spinning machines comprising circulating a working machine having a detector along a rail for monitoring the running conditions of the spinning machines in which a transmitter provided in the working machine transmits a first information signal indicating the nature of possible abnormal conditions of each spinning machine to a remote station having a receiver and a computer. In the receiver, a second information signal is generated and successively stored in registers depending on the nature of the abnormal conditions in accordance with the first information signal received. The computer reads the contents of the registers only when an interrupt signal is generated which indicates that an abnormal condition has occurred in a particular spinning machine. The computer memory tabulates these data and updates the data each time the working machine circulates around the spinning machines. Thus, by counting the data in the memory, the running conditions of the spinning machines can be effectively monitored. Furthermore, the number of inputs to the computer can be effectively reduced by limiting the input data to the computer to a minimum.

7 Claims, 10 Drawing Figures

303
304
DECODER
17
15
16
302
300
302
5
4
6
3
2
1
BLOCK
306
301

PERMANENT MAGNET
302
16
305
15
10
11
12
13
14
5
4
6
LIMIT SWITCH
3
2
OPERATION CONTROL CIRCUIT
1
DATA TRANSMITTING DEVICE

MONOSTABLE MULTIVIBRATOR
PULSE OSCILLATOR
M
34
35
N
FREQUENCY MODULATOR
16
15
29
V
36
MONOSTABLE VIBRATOR
F
G
T S R Q
28
E'
23
27
D
E
37
RELAYS
FLIP FLOP
S
R
I
20
24
31
J
A
21
25
32
B
K
N'
22
26
33
FLIP FLOPS
38
C

DEMODULATION CIRCUIT
MONOSTABLE MULTIVIBRATOR
PULSE OSCILLATOR
BIT COUNTER
FLIP FLOPS
SPINDLE COUNTER
MONOSTABLE MULTIVIBRATOR
MONOSTABLE MULTIVIBRATOR
17
121
104
B
105
C
A
106
=2
=3
=4
110
107
108
109
S
R
117
118
119
111
D
112
125
122
123
124
113
E
114
115
116
120
103
102
101
K

Fig. 9

| SPINDLE NUMBER | LAST TIME YARN BREAKAGE | THIS TIME YARN BREAKAGE | LAST TIME YARN TYING FAILURE | THIS TIME YARN TYING FAILURE | LAST TIME EMPTY SPINDLE | THIS TIME EMPTY SPINDLE | TOTAL COUNTING OF YARN BREAKAGE | TOTAL COUNTING OF YARN TYING FAILURE | TOTAL COUNTING OF EMPTY YARN |
|---|---|---|---|---|---|---|---|---|---|
| 1 | 0 | 0 | 0 | 0 | 0 | 0 | | | |
| 2 | 0 | 0 | 0 | 0 | 0 | 0 | | | |
| 3 | 1 | 0 | 0 | 0 | 0 | 0 | | | |
| 4 | 0 | 1 | 0 | 1 | 0 | 1 | | | |
| 5 | 1 | 1 | 1 | 0 | 0 | 0 | | | |
| 6 | 1 | 1 | 0 | 1 | 0 | 0 | | | |
| 7 | 0 | 0 | 0 | 0 | 1 | 1 | | | |
| ---- | ---- | ---- | ---- | ---- | ---- | ---- | | | |
| ---- | ---- | ---- | ---- | ---- | ---- | ---- | | | |
| ---- | | | | | | | | | |
| ---- | | | | | | | | | |
| ---- | | | | | | | | | |
| n-1 | | | | | | | | | |
| n | | | | | | | | | |

METHOD AND APPARATUS FOR DETECTING AND RECORDING ABNORMAL CONDITIONS IN THE OPERATION OF SPINNING MACHINES

BACKGROUND OF THE INVENTION

Yarn breakage detecting devices which detect yarn breakages on respective spindles and give warning on detection thereof have heretofore been mounted on spinning machines. When warning is given by such detecting device an operator goes to a spindle where yarn breakage has taken place and ties the cut ends, or a yarn tying device is moved along the row of spindles to perform the tying operation in accordance with the instructions of the yarn breakage detecting device.

As the method for obtaining operational data from such yarn breakage detecting device, there is generally adopted a method in which special time zones are formed and an operator sees the operational condition of the warning device and records the operational data. If the number of operators is reduced in accordance with the recent demand for reduction of labor, sufficient detection accuracy or investigation can not be expected using this method. Therefore many operators should be engaged in this detection operation in order to obtain precise data. Further, there is often adopted a method in which an expert judges the working condition during a short glance at the machine. However, this method cannot be said to be a correct method and detailed data cannot be obtained by means of this method.

As means for overcoming the foregoing defects and disadvantages, there has been developed a method in which yarn breakages on spindles are detected by a so-called working machine, such as a yarn tying device or a moving cleaner, which is moved along a row of spindles of the spinning machine and performs some operation. Data indicating the operational condition of the working machine, namely data showing whether or not the operation of the working machine has been successfully carried out, and data indicating the yarn breakage condition of each spindle are collectively conveyed to a data processing equipment such as a digital computer. Collection, processing and integration of the data are performed by this data processing equipment so that recorded data are displayed at any time according to need. According to this method, operational data of high precision can be obtained while saving time and labor. However, this method utilizing a working machine and collecting data of operational conditions of the spinning machine and working machine involves the following serious problems.

In collecting data showing the operational conditions of the spinning machine and working machine from the working machine being moved around the spinning machine, if the working machine performs its operation every moment it passes by each spindle of the spinning machine, the time required for the working machine to shift from one spindle to the next spindle is generally about 0.5 to about 1 second, though this time varies depending on the moving speed of the working machine, and signals are applied to the data processing equipment at a frequency substantially equal to this time.

In the case where one working machine is provided for a great number of spinning machines, the interval at which the working machine passes one specific spindle is very much prolonged. Accordingly, in general, one working machine is provided for one or several spinning machines. Therefore, when a large number of spinning machines is employed, the number of working machines should be increased accordingly. In this case, if data are transmitted from respective working machines to the data processing equipment at intervals as mentioned above, the quantities of the data to be transmitted to the data processing equipment are drastically increased and the load imposed on the data processing equipment is also drastically increased.

If the load on the data processing equipment is increased for the reason set forth above, it will be appreciated that it will be impossible for the processing equipment to process various data precisely. Accordingly, it is necessary to reduce the amount of data to be applied to the data processing equipment as much as possible. More specifically, if all of the data as to whether or not yarn breakage takes place, data as to whether the operation of the working machine is successfully or unsuccessfully carried out and other data are not applied in succession to the data processing equipment but necessary minimum data alone are selectively applied to the data processing equipment, the abovementioned insufficient processing owing to overload can be eliminated and the capacity of the data processing equipment can be drastically reduced. However, no specific means capable of meeting such demand has been developed as yet.

OBJECTS OF THE INVENTION

It is therefore a primary object of this invention to provide a spinning machine controlling method which can overcome the foregoing defects and disadvantages involved in the conventional techniques, by which signals applied to a data processing equipment from a working machine moved around a spinning machine to detect the operational condition of the spinning machine are limited to data concerning defective spindles, whereby the input from the working machine is reduced to a necessary minimum level and the load on the data processing equipment is drastically reduced, and by which data necessary for automatic operation of the spinning machine can be obtained assuredly and promptly.

Another object of this invention is to provide a spinning machine controlling method by which the inspection of a spinning machine by a working machine and the detection of the operational condition of the working machine can be mechanized, whereby the number of operators for inspecting the operational condition of the spinning machine can be reduced without degradation of the quality of data to be applied to a data processing equipment.

Still another object of this invention is to provide a spinning machine controlling method in which the load on a data processing equipment can be reduced regardless of the sizes or manner of arrangement of a spinning machine and a working machine for detecting the operational condition of the spinning machine and data can be processed precisely by the data processing equipment.

Other objects and features of this invention will be apparent from the following detailed description.

BRIEF DESCRIPTION OF THE DRAWINGS

FIG. 9 illustrates a data table set in a data processor.

DETAILED DESCRIPTION OF THE INVENTION

In accordance with the fundamental aspect of this invention, there is provided a method for controlling spinning machines, which comprises moving a working machine around a spinning machine having a plurality of spindles to inspect the operational condition of the spinning machine, causing the working machine to perform an operation necessary for the spinning machine, and to produce signals of data of the inspection results or signals of data of the inspection results and the operational condition of the working machine, and applying said signals into a data processing equipment mounted separately and independently from the spinning machine to process the data with respect to each spindle of the spinning machine, wherein among data signals, only data concerning defective or bad spindles are applied to the data processing equipment.

The spinning machine referred to in the instant specification and claims includes a spinning machine for synthetic fibers, a drawing twister, a spinning frame, a twisting machine, a crimper and the like. In short, any machine having a plurality of spindles disposed therein is included in the spinning machine of this invention.

The working machine referred to in the instant specification and claims includes a detecting unit moving in front of the spinning machine (on the face to be inspected) or around the spinning machine and detecting spindles with broken yarn, a yarn tying device moving in front of or around the spinning machine detecting spindles with broken yarn and automatically tying cut ends, and a moving cleaner for removing waste, fly waste and the like equipped with yarn breakage-detecting means.

This invention will now be described in detail with reference to the accompanying drawings.

Figure 1:
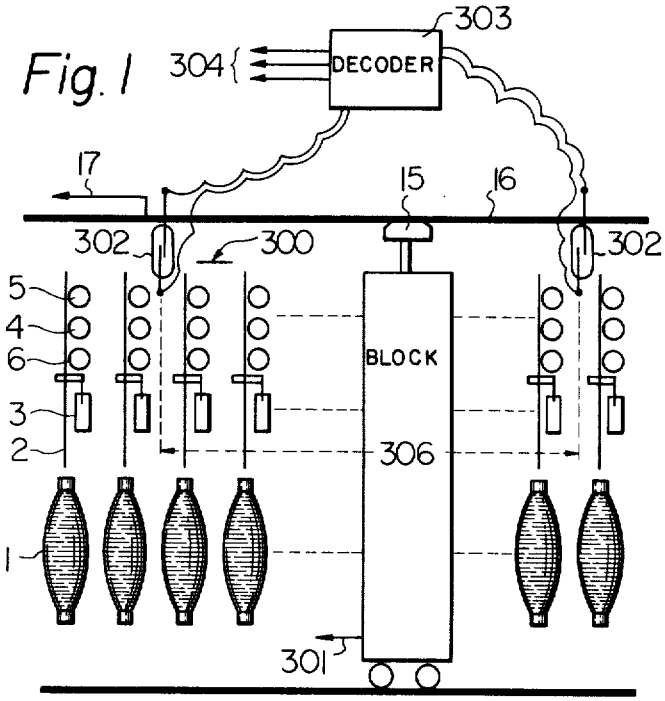
FIG. 1 illustrates a plane view in which a working machine is moving in front of spinning machines.
Figure 2:
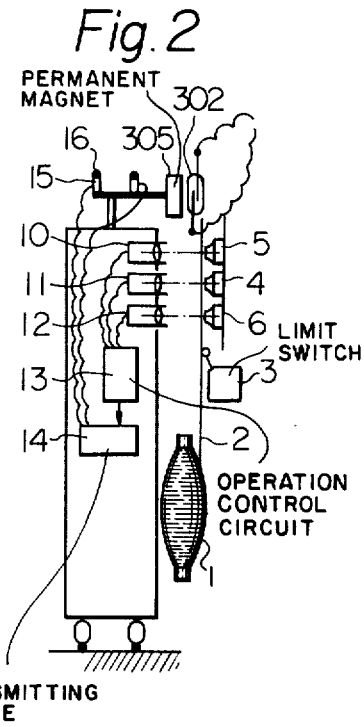
FIG. 2 illustrates a side view of FIG. 1.

FIG. 1 is a front view of a spinning machine 300 having a plurality of spindles arranged in rows, and FIG. 2 is a side view of this spinning machine. In an embodiment shown in these Figures, an automatic yarn tying device is used as the working machine. Of course, as pointed out above, a moving cleaner equipped with means for detecting the conditions of spindles and a moving unit having functions of detecting the conditions of spindles and transmitting data of spindle conditions to a data processing equipment disposed separately can be used as the working machine.

Referring now to FIGS. 1 and 2, reference numeral 1 denotes a bobbin and yarn 2 is wound on this bobbin 1. Reference numeral 3 denotes yarn breakage detecting limit switch and one limit switch 3 is provided for every spindle. When yarn 2 is broken or cut, the detecting limit switch 3 is actuated to turn on a yarn breakage indicating lamp 4. Reference numeral 5 denotes a spindle position indicating lamp, and this lamp is always lighted. Reference numeral 6 denotes an empty spindle indicating lamp, which is turned on when the corresponding spindle is empty and not used. A series of these lamps 3, 4 and 5 is provided for each spindle of the spinning machine.

Rails 7 are laid in a direction parallel to the rows of spindles, and an automatic yarn tying device 9, having wheels 8 attached thereto, is disposed so that it travels on the rails 7 in a direction indicated by an arrow 301. This automatic yarn tying device 9 detects the lighting condition of yarn breakage indicating lamps 4, and when yarn is broken on one spindle and the corresponding lamp is lighted, the device 9 stops at this spindle and automatically performs the yarn tying operation.

As shown in detail in FIG. 2, in the interior of the automatic yarn tying device 9, there are disposed a spindle position detector 10, a yarn breakage indication detector 11 and an empty spindle indication detector 12 which correspond to the spindle position indicating lamp 5, yarn breakage indicating lamp 4 and empty spindle indicating lamp 6 of the spinning machine, respectively. These detectors 10 to 12 are disposed so that they detect the position of the spindle, the presence or absence of yarn breakage on the spindle and the empty or full state of the spindle based on the absence or presence of light transmitted by respective lamps, and they transmit detection signals to an operation control circuit 13. A data transmitting device 14 is further disposed in the interior of the automatic yarn tying device 9 to pick up from the operation control circuit 13 of the yarn tying device 9 a yarn breakage signal indicating occurrence of yarn breakage, a failure signal showing failure in the yarn tying operation, an empty spindle signal indicating the emptiness of the spindle, and a spindle passage signal generated every moment it passes respective spindles. Yarn breakage signals, failure signals and empty signals are sporadically picked up, and a signal pattern is transmitted with spindle passage signals as triggers to a data processing equipment disposed separately.

Figure 3:
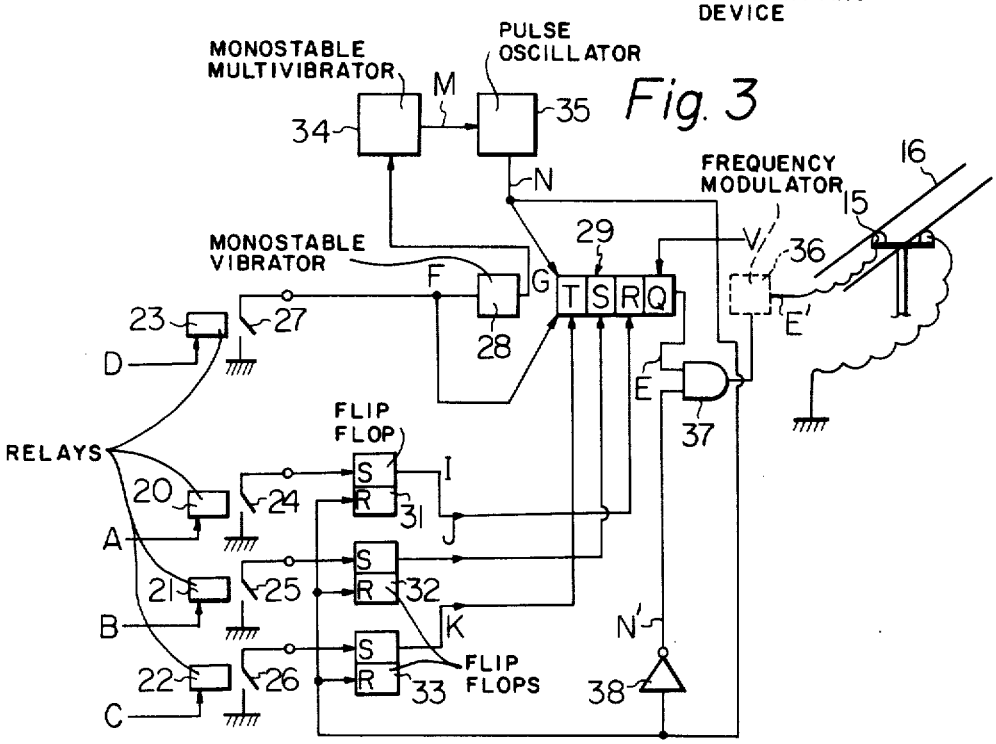
FIG. 3 illustrates a circuit construction of a spindle passage signal transmitting device.
Figure 4:
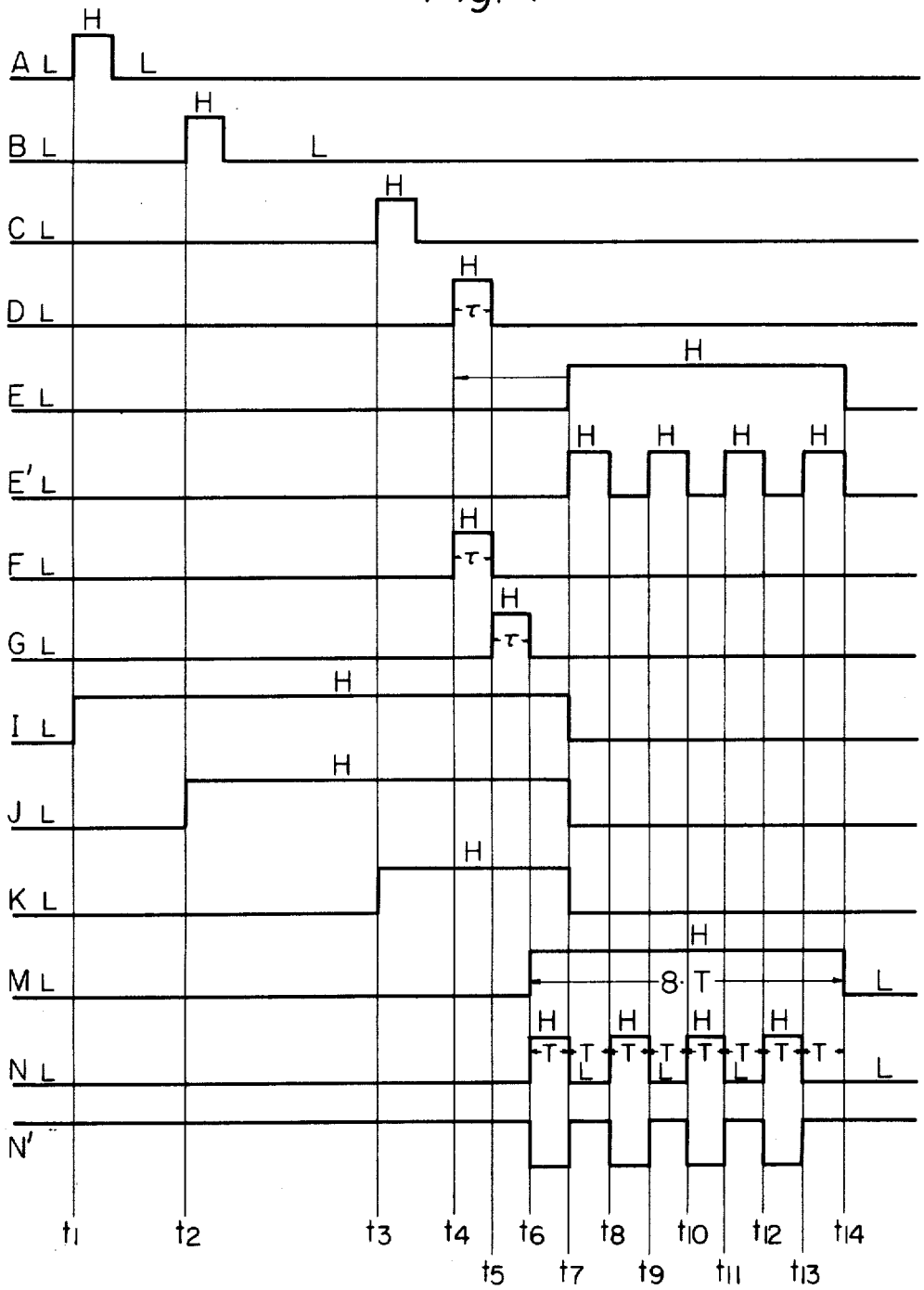
FIG. 4 illustrates a timing chart showing each wave form at particular points in the circuit of FIG. 3.

An example of the circuit of this data transmitting device 14 is shown in FIG. 3. Referring now to FIG. 3, yarn breakage signal A, failure signal B, empty spindle signal C and spindle passage signal D coming from the operation control circuit 13 are received by relays 20, 21, 22 and 23, and these signals are then picked up through contacts 24, 25, 26 and 27 of these relays. Numeral 9 is a working machine and 15 is a collector element as shown in FIGS. 1 and 2. An example of the pattern of these yarn breakage, failure, empty spindle and spindle passage signals A, B, C and D is illustrated in FIG. 4. In FIG. 4, L denotes a logical output of 0 (zero), namely "absence", and H denotes a logical output of 1, namely "presence". In the signal pattern shown in FIG. 4, H appears at the times $t_1$ and $t_2$. Accordingly, it is seen that yarn breakage occurs on a certain spindle and the tying operation tried on this spindle miscarries. In fact, however, since H is indicated by the empty spindle signal C at the time $t_3$, this spindle is empty.

More specifically, by the indication H put out by the yarn breakage signal A at the time $t$, the relay 20 is actuated to close the contact 24 and a flip flop 31 is set. This output I is converted from L to H at the time $t_1$ as indicated by I in FIG. 4. Similarly, by the indication H put out by the failure signal B at the time $t_2$, the relay 21 is actuated to close the contact 25, and a flip flop 32 is set. Thus, this output J is converted from L to H at the time $t_2$, as shown in FIG. 4. Similarly, by the indication H put out by the empty spindle signal C, the relay 22 is actuated to close the contact 26 and a flip flop 33 is set. Thus, this output K is converted from L to H at the time $t_3$ as shown in FIG. 4. After signals A, B and C are stored in flip flops 31, 32 and 33, at the point when the indication H of the spindle passage signal D is received at the time $t_4$, as shown in FIG. 4, the relay 23 is actuated to close the contact 27, whereby a signal F is obtained. Since this signal F is applied to a preset terminal of a shift register 29, at the time $t_4$ outputs I, J and K of the flip flops 31, 32 and 33 are preset at bits R, S and T of the shift register 29, respectively. A certain voltage V is connected to the rightmost bit (Q in FIG. 3) of the shift register so that the logical output of 1 is always maintained. Accordingly, the bit Q always has a logical output of 1, namely the output H, and the bit Q always acts as a front bit of the data. At the time $t_5$ when the signal F is converted from H to L, the output G of a monostable multivibrator 28 is changed from L to H as shown in FIG. 4, and at the time $t_6$ when this signal G is converted from H to L, the output M of a monostable multivibrator 34 shown in FIG. 3 is caused to generate pulse H during a period of 8T so that four pulses are generated from a pulse oscillator 35 oscillating at a certain cycle T. Namely, the output M of the monostable multivibrator 34 is maintained at H during a period from $t_6$ to $t_{14}$. The reason for this is that the shift register 29 comprises Q, R, S and T positions. If the information to be transmitted comprises other signals in addition to the above-mentioned yarn breakage, failure and empty spindle signals, a shift register having $(n + 1)$ bits, in which $n$ is the total number of the signals, is used and the output M is caused to generate such pulse that H is maintained during a period of $2(n + 1)T$.

The output N of the pulse oscillator 35 generates from pulses at a certain cycle T while the theoretical output M of the monostable multivibrator 34 is maintained at H, namely during a period of $t_6$ to $t_{13}$ in FIG. 4. The output N of the pulse oscillator 35 is connected to the shift input terminal of the shift register 29, and when one pulse is applied from the signal N during a period of $t_6$ to $t_7$, all of the bits Q, R, S and T of the shift register 29 are simultaneously shifted; Q, R, S and T are put in E, Q, R and S, respectively and the logical output of O or L is put in T. Accordingly, the output E of the shift register 29 is changed from L to H at the time $t_7$ as shown in FIG. 4. In the same manner, bits R and S of the shift register 29 are pushed on the output signal E by the pulses of signals N at the points of times $t_8$–$t_{11}$, respectively. Finally, by the pulse at the point of $t_{12}$–$t_{13}$, the signal T is made to appear on the output signal E of the shift register. This output E is transmitted as the output signal E′ of the data transmitting device 14 by calculating the logical product from a reversed signal of the output N of the pulse oscillator 35, namely a signal of the output N′ of a negation element (NOT element) 38, and a signal of an AND element 37.

More specifically, bit information Q, R, S and T of the shift register 29 is converted to serial signals arranged in series to the time axis, which are transmitted as output signals E′. In this case, the order to eliminate transmission errors by friction between a trolley wire and a collector element or noises incorporated in a trolley wire or a transmission wire, it is preferred that the output signal E′ be passed through a frequency modulator 36 to effect frequency modulation so that it is converted to a sine wave of a frequency $f_L$ (for example, 50 KHZ) in the case where the output of the shift register 29 is at L, or a frequency $f_H$ (for example, 100 KHZ) in the case where the output of the shift register 29 is at H, or to another suitable triangular wave or pulsating wave.

The output N of the pulse oscillator 35 is also connected to reset terminals of the flip flops 31, 32 and 33, and at the point of the time $t_7$ in FIG. 4, the flip flops are reset to prepare for an input of subsequent data.

The output signal from the data transmitting device 14 is passed through a collector element 15 and a trolley wire 16, and is transmitted through a transmission wire 17 to a data receiving device 100 disposed in an operation chamber or data processing chamber positioned separately from the spinning machine.

Figure 5:
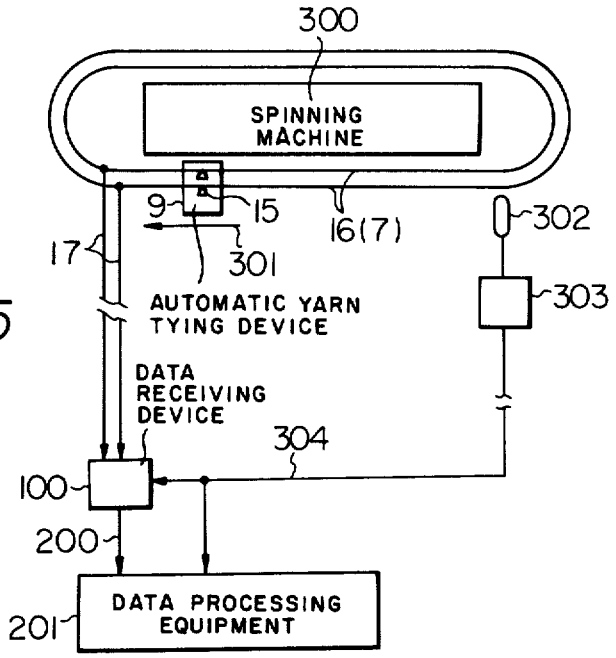
FIG. 5 illustrates a lay-out of a conventional trolley wire for collecting data from a working machine.

FIG. 5 is a diagram illustrating the course for transmission of signals received by the automatic yarn tying device. The signal transmitted by the transmission wire 17 is received by the data receiving device 100, and the signal of this device is introduced into a data processing equipment 201 through a signal wire 200.

If a method in which all of the data showing whether or not yarn breakages have taken place, data showing whether or not yarn tying operations are successful and other data are transmitted is adopted, and the load imposed on the data processing equipment is drastically increased. One of characteristic features of this invention is that this problem of an excessive load on the data processing equipment is solved by feeding only necessary minimum data to the data processing equipment.

More specifically, in accordance with this invention, as is illustrated in FIG. 5, a passage detector 302 is disposed to detect the time when the automatic yarn tying device 9 passes the prescribed position of the spinning machine 300, and by utilizing this passage signal in combination with the signal showing the operational condition of the spindle, it is made possible to greatly reduce the data input frequency in the data processing equipment. This feature will now be illustrated in detail.

The number of normal spindles is much greater than the number of so-called defective spindles on which such troubles as yarn breakage and empty spindle take place. Accordingly, if only signals of defective spindles, the number of which is very limited, are selectively transmitted to the data processing equipment 201 without transmitting data of normal spindles from the automatic yarn tying device 9 to the data transmitting device 201, the frequency of receipt of the data and processing thereof can be much reduced in the data processing equipment, and hence, the capacity of the data processing device can be minimized. However, since data of normal spindles are not transmitted to the data processing equipment 201, an arrangement must be made so that it can be known at some point that yarn tying has been successfully accomplished on the spindle with broken yarn and this spindle has been returned to the normal state. For attaining this purpose, in this invention, at least one standard point is set on the circuit course where the automatic yarn tying device 9 travels around the spinning machine, a filing operation for collection of data in the interior of the data processing equipment and an operation for transfer, processing and erasing of information from a memory such as a storage device is performed every time the automatic yarn tying device 9 passes through this standard position (this operation will be referred to as "file resetting operation" hereinafter). If only data concerning defective spindles are written in the reset file and thus collected, the load on the data processing equipment 201 can be greatly reduced. In order to embody this idea, in this invention, a passage detector is disposed on the circuit course of the automatic yarn tying device 9 to inspect the circuit condition of the automatic yarn tying device 9.

More specifically, as illustrated in FIG. 5, trolley wires 16 and rails 7 are laid around the spinning machine 300, so that the yarn tying device 9 as the working machine is moved in the direction indicated by an arrow 301 to turn around the spinning machine 300 and perform the prescribed operation. A passage detector 302 is disposed at least on one point along the circuit course of the automatic tying device 9 to detect that the automatic yarn tying device 9 passes through said point while it is travelling around the spinning machine 300. The output signal of the passage detector 302 is fed to a block number decoder 303 and amplified and wave-transformed by the decoder 303, and it is then fed as an input into the data processing equipment and data receiving device 100 through a signal wire 304.

Figure 6:
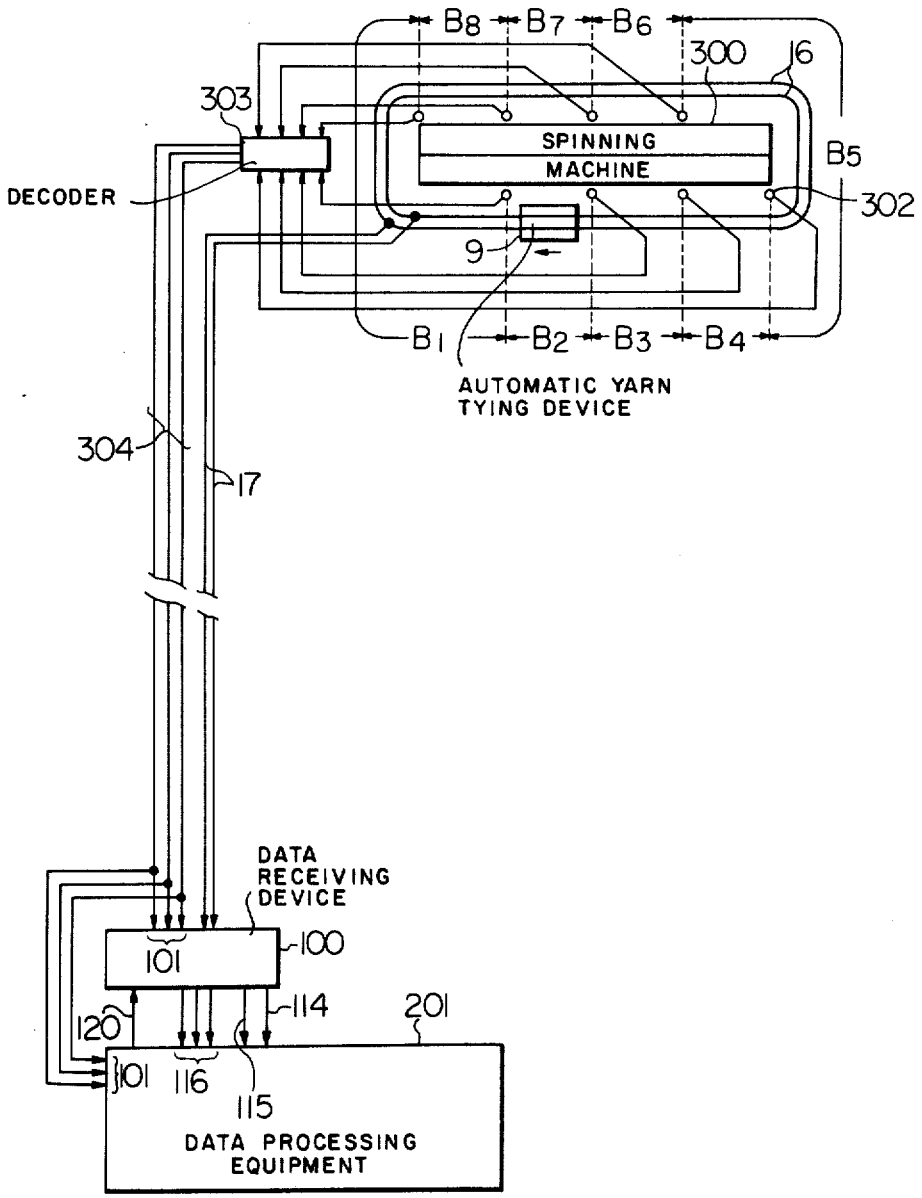
FIG. 6 illustrates a detailed block diagram of FIG. 5.

In this invention, a plurality of passage detectors 302 may be disposed as illustrated in FIG. 6. When a plurality of passage detectors 302 is disposed as shown in FIG. 6, a plurality of sections defined by these passage detectors 302 is formed. Accordingly, if an arrangement is made such that a signal indicating that the working machine is passing through a specific section can be read out, even when a disorder is brought about in a signal transmitted by the working machine at any section, the disorder can be treated as noise or data error at this section, and therefore, there can be attained an advantage that the influence of a data error such as an error in counting the spindle number brought about at one section can be prevented from ranging over other sections. In addition, the reliability of the output from the data processing equipment can be greatly improved.

This embodiment where a plurality of passage detectors is disposed will now be illustrated in more detail.

As is shown in FIG. 1, a suitable number of spindles is gathered to form a block 306, and a passage detector 302 consisting of a magnetic proximity switch such as a lead switch is disposed at each boundary between two adjoining blocks. A permanent magnet 305 is mounted on the automatic yarn tying device 9, and a block number decoder 303 is disposed to automatically decode which passage detector 302 is actuated every time the automatic yarn tying device 9 passes through the boundary between two adjoining blocks and to transmit the decoded data to the data receiving device 100 and the data processing equipment 201 of a higher rank through a transmission wire 304. In the embodiment shown in FIG. 6, the spinning machine 300 is divided into eight blocks $B_1$, $B_2$, . . . $B_8$, each block including scores of spindles.

Figure 7:
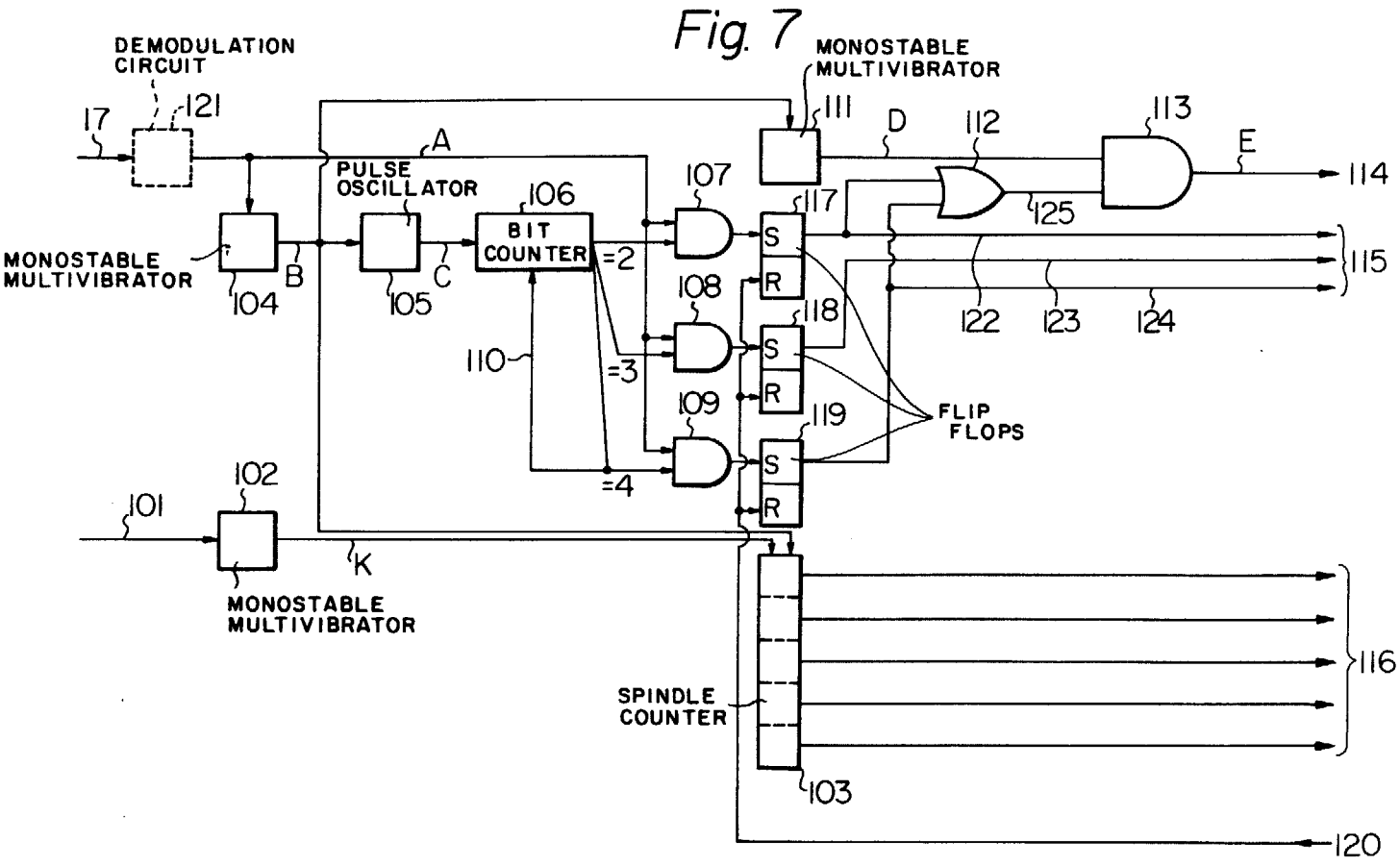
FIG. 7 illustrates a circuit construction of a data receiving device.

The circuit structure of the data receiving device 100 is illustrated in FIG. 7. Every time the automatic yarn tying device 9 utilized as the working machine passes through the boundary between two adjoining blocks, a block number signal 101 is applied the data receiving device 100, and every time this signal is changed, one pulse is transmitted from a monostable multivibrator 102 to clear data on a spindle counter 103. Clearance of the spindle counter 103 is accomplished by signal K shown in FIG. 7. Accordingly, the spindle counter 103 always counts the number of spindles included in one block. Therefore, even if the spindle counter 103 makes an error at a certain point, when the automatic yarn tying device 9 passes through the next boundary between blocks, the spindle counter 103 is cleared. As a result, the error influences data of one block alone and hence, the reliability of data can be highly improved. If the spindles are thus counted block by block, it is necessary to know the absolute number of each spindle in the spinning machine 300. This can be established by inserting the transmission signal 101 from the block number decoder 303 in the data processing equipment of a higher rank and by performing the following operation:

$$\text{Spindle number} = (\text{block number} - 1) \times (\text{number of spindles in one block}) + (\text{valve on spindle counter } 103) \quad (1)$$

Figure 8:
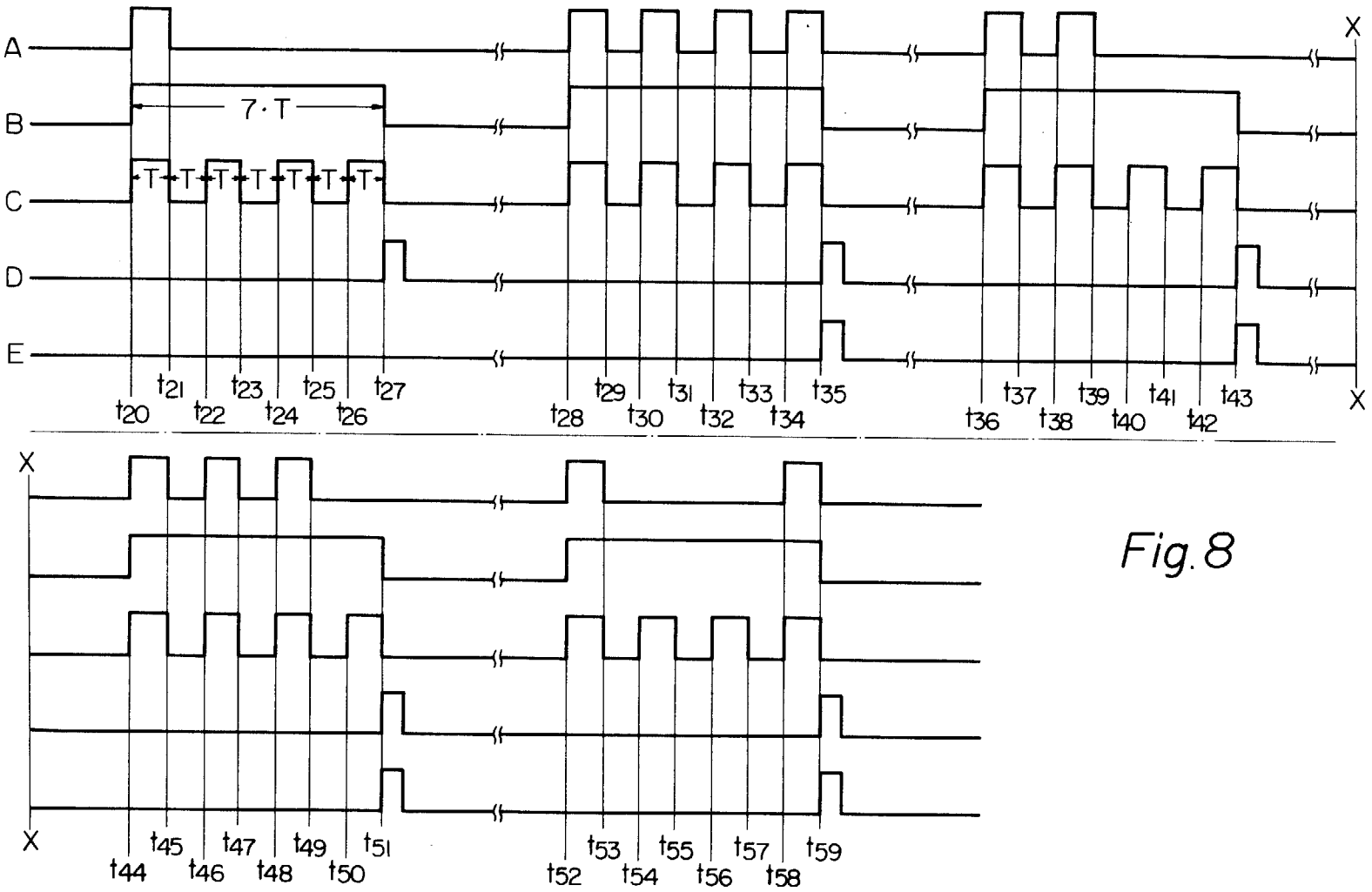
FIG. 8 illustrates a timing chart of each wave form appearing at particular points in the circuit of FIG. 7.

The function of the data receiving device 100 will now be described with reference to the circuit structure shown in FIG. 7. Supposing that a signal A shown in FIG. 8 is transmitted through a transmission wire 17, if this signal has been subjected to frequency modulation, the frequency-modulated signal is passed through a demodulation circuit 121 surrounded by a dotted line in FIG. 7 and converted to an ordinary pulse signal to obtain input signal A. In FIG. 8, inputs at times $t_{20}$ to $t_{27}$ are only those of leading bits, from which it is seen that the automatic yarn tying device 9 passed through normal spindles. In FIG. 8, it is also shown that at times $t_{28}$ to $t_{35}$ the three subsequent bits indicate yarn breakage, failure in the yarn tying operation and empty spindle, from which it is seen that the yarn tying device 9 has erroneously conducted a tying operation on a defective spindle, i.e., an empty spindle.

At times $t_{36}$ to $t_{43}$, only the yarn breakage bit appears after the leading bit, from which it is seen that the yarn tying device 9 has successfully conducted a yarn tying operation on a defective spindle, i.e., a spindle with a broken yarn.

At times $t_{44}$ to $_{51}$, bits indicating yarn breakage and failure in the yarn tying operation appear after the leading bit. Accordingly, it is seen that the automatic yarn tying device 9 has conducted a yarn tying operation on a defective spindle, i.e., a spindle with a broken yarn but the operation has ended in failure.

At times $t_{52}$ to $5_{59}$, bits indicating yarn breakage and failure in the yarn tying operation do not appear after the leading bit but only the final bit indicating an empty spindle appears. Accordingly, it is seen that the yarn tying device 9 has passed before a defective spindle, i.e., an empty spindle, without conducting any operation on this empty spindle.

Supposing that the signal of input A is applied to the data receiving device 100, the signal actuates the monostable multivibrator 104 to generate pulses, as signal B shown in FIG. 8, at an interval of 7·T corresponding to the time for four pulses of the signal N shown in FIG. 4. This signal B is applied to the pulse oscillator 105 of the next stage, and simultaneously, the value of the spindle counter 103 is increased by 1. The pulse oscillator 105 generates pulses, as signal C shown in FIG. 8, at the same frequency as the pulse oscillator 35 of the data transmitting device, and the output of the pulse oscillator 105 is fed into a bit counter 106 which counts the output pulse number of the pulse oscillator 105 and which conducts no operation if the counted number is 1. But if the counted number is 2, the counter 106 supplies the logical product of the input data signal A and the AND element 108 to the set terminals of a flip flop 117 to store the bit of the yarn breakage signal. When the counted number is 3 in the bit counter 106, the logical product is taken by the input data signal A and the AND element 108 and it is applied the set terminal of a flip flop 118 to store the bit of the signal of failure in the yarn tying operation. When the counted number is 4 in the bit counter 106, the logical product is carried out by the input data signal A and the AND element 109 and it is applied the set terminal of a flip flop 119 to store the bit of the empty spindle signal. The output generated when the counted number of the bit counter 106 is 4 is connected to the reset terminal by a signal wire 110 so as to reset the value of the bit counter 106 at 0.

From the foregoing illustration, it will be apparent that to the input A at times $t_{20}$ to $t_{27}$, all the outputs 122, 123 and 124 of the flip flops 117, 118 and 119 are those of L; and to the input A at times $t_{28}$ to $t_{35}$, the outputs 122, 123 and 124 are maintained at H. At times $t_{36}$ to $t_{43}$, the outputs 122, 123 and 124 are maintained at H, L and L, respectively, and at times $t_{45}$ to $t_{51}$ the outputs 122, 123 and 124 are maintained at H, H and L, respectively. At times $t_{52}$ to $t_{59}$ the outputs 122, 123 and 124 are maintained at L, L and H, respectively. Collection of data is accomplished by reading each of the outputs 122, 123 and 124 from the data processing equipment 201. However, since the timing for reading is not determined by the data processing equipment, it is necessary to transmit an interruption signal as a reading-requiring signal from the data receiving device.

In this invention, since only data concerning detection signals are transmitted to the data processing equipment 201, the intended object can be attained if an arrangement is made such that whenever a yarn breakage signal or empty spindle signal is transmitted (the signal indicating failure in the yarn tying operation need not be taken into consideration, because the yarn breakage signal is always transmitted whenever the failure signal is transmitted), a read-requiring signal is transmitted, as shown in FIG. 7. More specifically, an arrangement is made such that the output B of the monostable multivibrator 104 is applied to the monostable multivibrator 111 and a pulse is always generated whenever the output B is converted from H to L. The output of the monostable vibrator 111 is indicated as D in FIG. 8. When the logical sum of the outputs 122 and 124 of the flip flops 117 and 119 is carried out by an OR element 112 and the logical product of the output 125 of the element 112 and the output D of the monostable multivibrator 111 is produced as a read-requiring signal 114 by the AND element 113, good results can be obtained. Reference numeral 15 is a collector element, 16 is a trolley wire, numeral 301 shows the direction of the working machine, 302 is a working machine passage detector, 303 is a block number decoder, 30 is transmission lines, 305 is a permanent magnet, 306 is a block length. The state of this read-requiring signal is shown as E in FIG. 8. As is seen from FIG. 8, when spindles are in the normal state as at times $t_{20}$ to $t_{27}$, each of the outputs of the flip flops 117 and 119 are at L, and therefore, no pulse of the signal D is transmitted from the AND element 113. At each of times $t_{28}$ to $t_{35}$, $t_{36}$ to $t_{43}$, $t_{44}$ to $t_{51}$ and $t_{52}$ to $t_{59}$, since either of the outputs of flip flops 117 and 119 is at H, the pulse of the signal D is transmitted from the AND element 113 and introduced into the data processing equipment 201 as an interrupting read-requiring signal.

In the data processing equipment 201, when the read-requiring signal 114 is applied, the value of the spindle counter is read from the signal 116 and the spindle information; the information of the operational condition of the automatic yarn tying device 9 and the process information are read from the signal 115. Simultaneously, the value of the block number is read from the transmission signal 101, and the position of the spindle is calculated from the formula (1) and is stored in the file in the data processing equipment. Upon completion of the reading of data, the data processing equipment 201 transmits a short pulse as a reading completion signal from 120 shown in FIG. 7 to notify the data receiving device 100 of completion of reading. In the interior of the data receiving device 100, flip flops 117, 118 and 119 are reset by this signal of completion of reading and they are made ready for receipt of the subsequent spindle data input.

In the interior of the data processing equipment shown in FIG. 6, a file such as shown in FIG. 9 is provided.

Since the passage of the automatic yarn tying device 9 through the point of the passage detector 302 is detected by the data processing equipment 201, at the moment the yarn tying device 9 utilized as the working machine passes through the point of the passage detector 302, the value 0 is written in each of the columns "yarn breakage at this time", "failure in yarn tying at this time" and "empty spindle at this time". Then, the automatic yarn tying device 9 makes a circuit around the spinning machine 300 as indicated by an arrow 301 and during this circuit, the automatic yarn tying device 9 transmits data of defective spindles, i.e., broken yarn or empty spindles, to the data processing equipment 201. Whenever the device 9 transmits such process data, on the file in FIG. 9 in the interior of the data processing equipment, the value 1 is written in the columns yarn breakage at this time, failure in yarn tying at this time or empty spindle at this time in accordance with the transmitted process data. For example, supposed that the input A at times $t_{20}$ to $t_{27}$ shown in FIG. 8 is that of the spindle No. 3, since no interruption of the read-requiring signal is caused in the data processing equipment 201, in each of columns yarn breakage this time, failure in yarn tying at this time and empty spindle at this time of the third spindle the value is kept 0, and only the value on the spindle counter 103, disposed in the data receiving device 100, which corresponds to the spindle number, i.e., 3 is written. In case data of the input A of FIG. 8 at times $t_{28}$ to $t_{35}$ are those of the fourth spindle, value 1 is written in each of the columns yarn breakage at this time, failure in yarn tying at this time and empty spindle at this time of the fourth column in FIG. 9. Similarly, in case data of the inputs at times $t_{36}$ to $t_{43}$ are those of the fifth spindle, values 1, 0 and 0 are written in columns yarn breakage at this time, failure in yarn tying at this time and empty spindle at this time of the fifth column in FIG. 9, respectively. Supposed that data of the input at times $t_{44}$ to $t_{51}$ are those of the sixth spindle, values 1, 1 and 0 are written in the columns yarn breakage at this time, failure in yarn tying at this time and empty spindle at this time of the sixth spindle in FIG. 9, respectively. In case data of the input at times $t_{52}$ to $t_{59}$ are those of the seventh spindle, values 0, 0 and 1 are written in the columns yarn breakage at this time, failure in yarn tying at this time and empty spindle at this time of the seventh column in FIG. 9, respectively. When $n$ of spindles are disposed in one block, an arrangement is made such that data of all the spindles (from the 1st spindle to the $n$-th spindle) can be recorded in the file shown in FIG. 9.

When the automatic yarn tying device 9, utilized as the working machine, passes through the point of the passage detector 302 while making a circuit around the spinning machine 300, the data processing equipment 201 is informed of this passage by the block number decoder 303. Hence, in the interior of the data processing equipment 201, the value 0 is written in the column yarn breakage at this time in FIG. 9 with respect to spindles where yarn breakage does not take place during one circuit of the automatic yarn tying device 9 and the value 1 is written in the column yarn breakage at this time in FIG. 9 with respect to spindles where yarn breakage takes place during one circuit. Similarly, the value 1 is written in the column failure in yarn tying at this time or empty spindle at this time in FIG. 9 with respect to spindles in which the yarn tying operation has ended in failure or which are empty during one circuit of the yarn tying device 9, while the value 0 is written in the columns failure in yarn tying at this time and empty spindle at this time with respect to spindles on which such disorder does not take place.

In the file shown in FIG. 9, there are formed columns yarn breakage at last time, failure in yarn tying at last time and empty spindle at last time, and process conditions during the previous circuit are shown on in these columns. Accordingly, the process conditions inspected at the present circuit can be compared with the process conditions inspected during the previous circulation.

From data shown in FIG. 9, for example, it is seen that no yarn breakage has been detected either at the previous circuit or at the present circuit in the first and second spindles, and yarn is wound on these spindles in a normal condition. It is also seen that yarn breakage has taken place during the previous circulation in the third spindle but no yarn breakage takes place during the present circulation in this third spindle and yarn is wound in a normal condition. In the fourth spindle, it is seen that although yarn detected as being wound in a normal condition during the previous circulation, at the present circulation the spindle is empty and the automatic yarn tying device 9 erroneously conduct a yarn tying operation on this spindle. In the fifth spindle, during the previous circulation yarn breakage was detected and the automatic yarn tying device 9 failed in the yarn tying operation, but during the present circuit, the device 9 succeeded in tying the cut ends of the yarn. In the sixth spindle, during the previous circulation the yarn breakage was detected and the automatic yarn tying device 9 succeeded in the yarn tying operation, but during the present circulation yarn breakage was detected again and the device 9 failed in the yarn tying operation. In the seventh spindle, it has been empty during both the previous circulation and present circulation.

In the interior of the data processing equipment 201, the foregoing data are examined and the success or failure of the yarn tying device 9, utilized as the working machine, is examined with respect to each spindle. Based on such examination, spindles inferior in compatibility with the yarn tying device 9 are marked. If the abnormal operational state is continued, an alarm is given to an operator by a buzzer or the like, and in the file shown in FIG. 9, a value 1 is marked in the column addition of yarn breakages with respect to spindles on which yarn breakage takes place during the present circulation and a value 1 is marked in the column failures in yarn tying with respect to spindles on which the yarn tying operation has ended in failure. Further, a value 1 is marked in the column "empty spindle" with respect to spindles which were not empty during the previous circulation but are empty during the present circulation. However, since marking of the empty spindle should be made in connection with spindles which were empty during the previous circulation and are empty during the present circulation and spindles which were empty during the previous circulation but are not empty during the present circulation, the value of the column empty spindle is not changed with respect to these spindles.

In the foregoing manner, the interior of the data processing equipment wherein various judgments are made, collection, processing and addition of data are also performed, if the abnormal undesired operational state is continued, an alarm is given by a buzzer or the like and immediately, data in the columns yarn breakage at this time, failure in yarn tying at this time and empty spindle at this time in FIG. 9 are transferred to the columns yarn breakage at last time, failure in yarn tying at last time and empty spindle at last time, respectively. On completion of this data transfer, the value 0 is written in each of the columns yarn breakage at this time, failure in yarn tying at this time and empty spindle at this time, and the preparation for the next circuit is completed.

As is seen from the foregoing illustration, this invention is characterized in that data of all the spindles are not introduced into the data processing equipment but, among data of defective spindles or a plurality of spindles, only data of a low occurrence frequency are fed into the data processing equipment, whereby the load on the data processing equipment can be drastically reduced. Further, there is provided a time allowance for the operation of the data processing equipment involving disposal of various data and especially collection, addition and processing of data indicating the yarn breakage stage in the spindles of the spinning machine. In addition, such operation as warning can be performed very well whereby erroneous operations can be completely prevented in the data processing equipment. When the data stored in the flip flops 117, 118 and 119 shown in FIG. 7 are read out from the data processing equipment 201, if a clock is provided in the data processing equipment 201, since the time can be recorded, data of the total frequencies of yarn breakages at a prescribed interval can be collected in connection with respective spindles or data of the total frequencies of yarn breakages in the entire spinning machine can be obtained by addition. Moreover, data of the total frequencies of failures in the yarn tying operation in the entire spinning machine can be obtained, and data of the number of empty spindles or data of the overall spindle-empty time in the entire spinning machine can be obtained by addition. Based on these data, it is possible to calculate the working ratio and efficiency of the spinning machine or the yarn tying operation failure ratio (= addition value of frequencies of the failure in the yarn tying operation/addition value of frequencies of yarn breakages) and inform an operator of the calculation results, according to need, by putting the results in a display device or recording device disposed separately from the spinning machine and the automatic yarn tying device. When the yarn tying operation ends in failure at a frequency higher than the prescribed frequency, it is possible to give warning as regards the maintenance of the automatic yarn tying device. Further, it is possible to indicate to an operator spindles on which yarn breakages take place at a frequency higher than the prescribed frequency, whereby maintenance of spindles can be greatly facilitated.

In case a working machine moving around the spinning machine at a constant speed without stopping is provided with a yarn breakage-inspecting or supervising capacity and this working machine with yarn inspection device or yarn supervising device is moved around the spinning machine at a speed of one circuit per certain time Tm, the next control can be performed. More specifically, in the foregoing data collecting method, it is possible to let the data processing equipment judge that the yarn is kept broken during a period from the point when the yarn was first broken to the point when the working machine has completed N circuits around the spinning machine and that the yarn breakage is not observed at the (N + 1)th circuit. Based on this judgement, it is made apparent that the yarn has been broken during a period of $N \times Tm$, and the quantity of yarn on the spindle can be calculated with respect to each of the spindles of the spinning machine according to the following equation:

$$\text{Quantity of yarn wound on spindle} = \text{yarn winding speed} \times (\text{doffing time} - \text{sum of periods during which yarn is broken}) \quad (2)$$

Results of the calculation can be put in a display device or recording device disposed separately from the spinning machine and the working machine to inform an operator of the calculation results as occasion demands. Alternately, instructions can be directly given to an automatic doffing device from the data processing equipment 201 to cause the automatic doffing device to perform assortment of yarn-wound bobbins. When the automatic yarn tying device 9 is used as the working machine with a yarn inspection device, since the automatic yarn tying device 9 stops before a spindle with a broken yarn and conducts the yarn tying operation, there is a fear that the measurement accuracy will be lowered as regards the time ranging from the point of occurrence of yarn breakage to the point of completion of the yarn tying operation. More specifically, in the case of the working machine with a yarn inspection device moving around the spinning machine at a constant speed, the time required for the working machine to make one circuit around the spinning machine is always constant and the accuracy in measurement of the time during which yarn is broken in a certain spindle corresponds to the time required for the working machine to make one circulation. When the above-mentioned automatic yarn tying device 9 is used as the working machine, if yarn breakage is detected during the present circulation even though yarn breakage was not detected during the previous circulation at this point of detection the automatic yarn tying device performs the yarn tying operation. Accordingly, no trouble is brought about if the time during which the yarn is broken can be regarded as being substantially equal to the time required for the automatic yarn tying device to make one circuit around the spinning machine, but there is a fear that the time for making one circuit will differ greatly between the case where yarn breakages take place in many spindles and the case where the number of spindles where yarn breakage takes place is small and hence, the accuracy in measurement of the time during which yarn is broken will be lowered. However, when it is apparent that the number of spindles where yarn breakage takes place is small, no problem is practically brought about even when the automatic yarn tying device is used as the working machine with a yarn breakage inspection capacity and the quantity of wound yarn is calculated according to the above equation (2).

Figure 10:
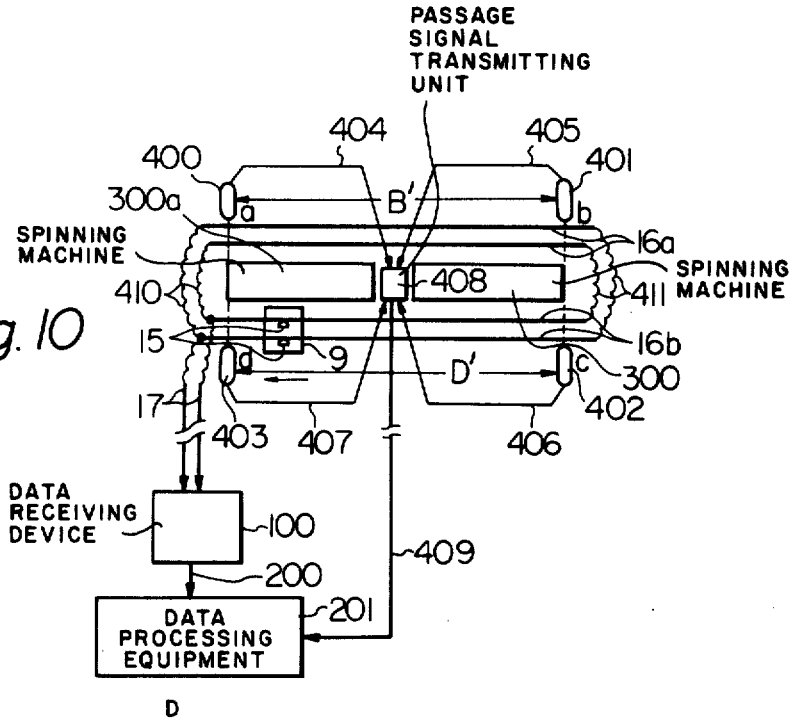
FIG. 10 illustrates a lay-out of trolley wire according to the present invention.

This invention includes an embodiment where the circuit passage of the automatic yarn tying device is divided into a data transmission effective region and a data transmission ineffective region as shown in FIG. 10.

More specifically, trolley wires 16*a* and 16*b* are laid so as to extend a little beyond the operation faces of spinning machines 300 and 300*a*, namely data transmission effective regions B' and D', and detectors 400, 401, 402 and 403 are disposed at positions corresponding to the terminal portions of the spinning machines 300 and 300*a* to detect the passage of the automatic yarn tying device 9 utilized as the working machine. Signals of these detectors are transmitted to a passage signal transmitting unit 408 through signal wires 404, 405, 406 and 407 and then put in the data processing equipment 201 from the unit 408 through a signal wire 409. The trolley wires 16*a* and 16*b* are electrically connected to each other by signal wires 410 and 411. In this embodiment of this invention, the trolley wires 16*a* and 16*b* are laid so that they extend a little beyond regions B' and D' necessary for transmission of process information (data transmission effective regions) as pointed out hereinabove, and side end portions of the spinning machines 300 and 300*a*, namely regions unnecessary for transmission of process information are not included in extensions of the trolleys 16*a* and 16*b*. Accordingly, the collector 15 begins to have contact with trolley wires 16*a* and 16*b* at parts exclusive of the regions B' and D' and then the collector 15 separates from the trolley wires 16*a* and 16*b*. With such contact or separation of the collector 15, chattering noises are transmitted into the data processing equipment 201 through the data receiving device 100, resulting in the defiling of collected data and reduction of reliability. In this invention, in order to eliminate this disadvantage, detectors 400, 401, 402 and 403 are disposed at both terminal portions of the data transmission effective regions B' and D' to detect the passage of the automatic yarn tying device 9 through said regions, so that data obtained in these regions alone are transmitted as effective data and processed in the data processing equipment 201. If a feature where a plurality of passage detectors 302 is provided, as shown in FIG. 6, is incorporated into the design of the detectors 400, 401, 402 and 403 to be used in this embodiment, better results can be obtained.

In this embodiment of this invention, where the periphery of the spinning machine is divided into a data transmission effective region and a data transmission ineffective region, trolley wires are laid so that they cover completely the data transmission effective region, but the extension of the trolley wires on the data transmission ineffective region is prevented as much as possible. The passage of the working machine through the data transmission effective region is confirmed by detectors, and operation data are collected based on confirmation of this passage. Consequently, the following effects can be attained by virtue of the above specific structure.

In the first place, since trolley wires are laid only on the data transmission effective region, namely the region where spindles of the spinning machines are arranged, the operation of laying the trolley wires can be facilitated and while the cost for this operation can be reduced.

Secondly, since detectors are mounted on both ends of the data transmission effective region and instructions for collection of data are given by these detectors, incorporation of chattering noises and other noises generated in the data transmission ineffective region can be prevented and operation data of higher reliability can be collected.

As is apparent from the foregoing illustration, according to the control method of this invention, data of respective spindles of the spinning machine and operational conditions of the working machine can be maintained and controlled effectively in all aspects while reducing the load imposed on the data processing equipment. Further, the wiring cost and the cost for provision of the data transmitting device, the data receiving device and the data processing device can be reduced. Accordingly, great effects can be obtained by a small equipment investment, and this invention provides great advantages when applied to the spinning and drawing steps in the synthetic fiber manufacturing process or to the spinning and twisting steps in the cotton spinning process.

What is claimed is:

1. A method of controlling spinning machines comprising the steps of:

providing at least one rail and transmission lines around a plurality of spinning machines in blocks;

circulating at least one working machine having a detector along said rail for monitoring the running conditions of said spinning machines;

detecting said running conditions of each spinning machine by said detector and transmitting a first information signal having unique characteristic portions indicative of the nature of possible abnormal conditions of each spinning machine in accordance with the detected signals through said transmission lines;

receiving said information signal at a remote central station having data receiving and registering means and a data processor;

generating a second information signal having unique characteristic portions indicative of the nature of abnormal conditions of spinning machines in accordance with the first signal and registering successively said characteristic portions of said second signal into registers;

reading the contents of registers into said data processor successively during one cycle of monitoring operations only when an interrupt signal, indicating that the occurrence of an abnormal condition, is generated;

tabulating the data thus read in the data processor, and;

updating the data in a memory in the processor each time said working machine moves once around the spinning machines.

2. The method set forth in claim 1 wherein said characteristic portions consist of signals corresponding to a position of a spindle, yarn breakage, yarn-tying failure and empty spindle.

3. The method set forth in claim 1 wherein the method further comprises:

counting the number of abnormal conditions for each spindle in accordance with the data stored in the memory of the data processor and indicating the counting on a displaying device so that said working machine is quickly accessible to a particular spinning machine to be taken care of.

4. The method set forth in claim 1 wherein said method further comprises:

clearing a spinning counter each time one block of spinning machines passes by and calculating each spinning number by said data processor in accordance with the contents of a value of a spinning counter and block numbers.

5. The method set forth in claim 1 wherein said method further comprises:

rewriting data indicative of the nature of abnormal conditions of spinning machines to other normal information in the memory of the data processor when a particular spinning machine which has had a failure is restored.

6. An automatic spinning machine monitoring system which comprises:

at least one working machine having a detector for detecting the running conditions of each spinning machine and the passage of spindle positions;

at least one rail and transmission lines for circulating said working machine along said rail;

data transmission means connected to said detector for receiving detected signals and for generating and transmitting a first information signal having unique characteristic portions corresponding to the nature of possible abnormal conditions of each spinning machine through said transmission lines;

receiving and registering means having a plurality of input registers and a spinning number counter coupled to said transmission lines for receiving said first information signal and selectively registering said characteristic portions of said first signal into said registers, and;

a data processor having a memory means and coupled to said receiving and registering means for reading only data indicative of the nature of existing abnormal conditions of spinning machines from said registers and for processing said data so as to indicate one or more particular spinning machines to be taken care of.

7. The automatic spinning machine monitoring system set forth in claim 6 further comprising:

a plurality of detectors for detecting each block of spinning machines and for controlling said spinning counter by the output therefrom, whereby the contents of said spinning counter are read into the data processor each time an interrupt signal indicative of there having occurred an abnormal condition is generated such that the relationship between the second signal indicative of each abnormal condition coincides with a related spinning number thereof.

* * * * *